US005082676A

United States Patent [19]

Love et al.

[11] Patent Number: 5,082,676

[45] Date of Patent: Jan. 21, 1992

[54] COFFEE CASSETTE

[75] Inventors: Graham Love; Karl Schellhaass; Bärbel Rathjen, all of Bremen; Jürgen Schwarz, Bremerhaven, all of Fed. Rep. of Germany

[73] Assignee: Hag Gf Aktiengesellschaft, Bremen, Fed. Rep. of Germany

[21] Appl. No.: 649,205

[22] Filed: Jan. 25, 1991

Related U.S. Application Data

[63] Continuation of Ser. No. 351,735, May 15, 1989, abandoned.

[51] Int. Cl.[5] ..... B65D 85/00; B65B 29/02; A47J 31/00

[52] U.S. Cl. ..... 426/79; 426/77; 426/112; 426/394; 426/396

[58] Field of Search ..... 426/77, 78, 79, 112, 426/115, 433, 394, 396; 210/474, 482, 475; 99/295, 304, 306, 302 R, 317, 323

[56] References Cited

U.S. PATENT DOCUMENTS

| | | | |
|---|---|---|---|
| 1,412,388 | 4/1922 | Clermont | 99/295 |
| 2,539,771 | 1/1951 | Chambers | 99/295 |
| 2,822,273 | 2/1958 | Anderson | 99/295 |
| 2,936,695 | 5/1960 | Dondt | 99/295 |
| 3,083,101 | 3/1963 | Noury | 99/295 |
| 3,095,112 | 6/1963 | Weinstein et al. | 220/67 |
| 3,293,042 | 12/1966 | Eitzen | 426/77 |
| 3,387,553 | 6/1968 | Tavera | 426/77 |
| 3,411,431 | 11/1968 | Moeruni et al. | 99/304 |
| 3,607,299 | 9/1971 | Bolt | 426/77 |
| 3,811,373 | 5/1974 | Telco | 99/295 |
| 3,822,013 | 7/1974 | Vander Veken | 99/295 |
| 3,823,656 | 7/1974 | Vander Veken | 99/306 |
| 3,937,134 | 2/1976 | Molenaar et al. | 99/295 |
| 4,158,329 | 6/1979 | McKnight | 99/295 |
| 4,167,899 | 9/1979 | McCormick | 426/77 |
| 4,446,158 | 5/1984 | English et al. | 99/295 |
| 4,520,716 | 6/1985 | Hayes | 99/295 |
| 4,550,024 | 10/1985 | Le Granse | 99/295 |
| 4,867,993 | 9/1989 | Noroskog | 99/295 |
| 4,921,712 | 5/1990 | Malmquist | 99/295 |

FOREIGN PATENT DOCUMENTS

| | | | |
|---|---|---|---|
| 1042707 | 11/1978 | Canada | 426/77 |
| 1347892 | 11/1962 | France | 99/306 |
| 2270161 | 1/1976 | France | 426/77 |

*Primary Examiner*—Steven Weinstein
*Attorney, Agent, or Firm*—Linn I. Grim

[57] ABSTRACT

A cassette for producing coffee by the cup or pot and for use with a liquid receptacle having an internal locking flange. The cassette comprises a ring defining an interior and forming a bottom annular groove to receive the locking flange of the liquid receptacle and thereby to hold the cassette in place therein. The cassette further includes a plurality of ribs connected to and extending across the ring and separating the interior thereof into a multitude of sections, and coffee particles disposed in said sections. A bottom filter and a top filter are secured to the ring and extend across the bottom and top, respectively, of the interior of the ring to hold the flavoring particles therein. Preferably, the cassette is packaged in a sealed vacuum pack; and as it is so packaged, the mass of particles in each section of the cassette is reshaped slightly and formed into a firm conglomerate, which facilitates the subsequent flow of hot water through the cassette.

15 Claims, 3 Drawing Sheets

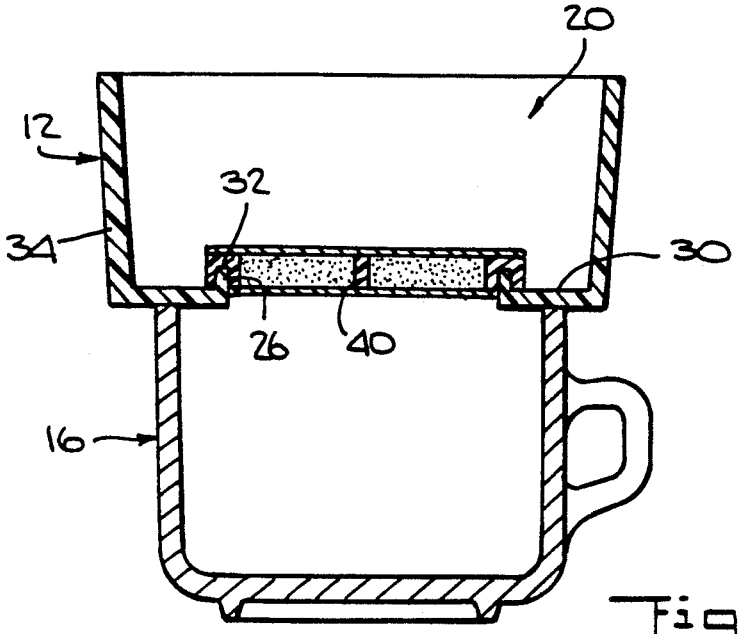
Fig. 1.
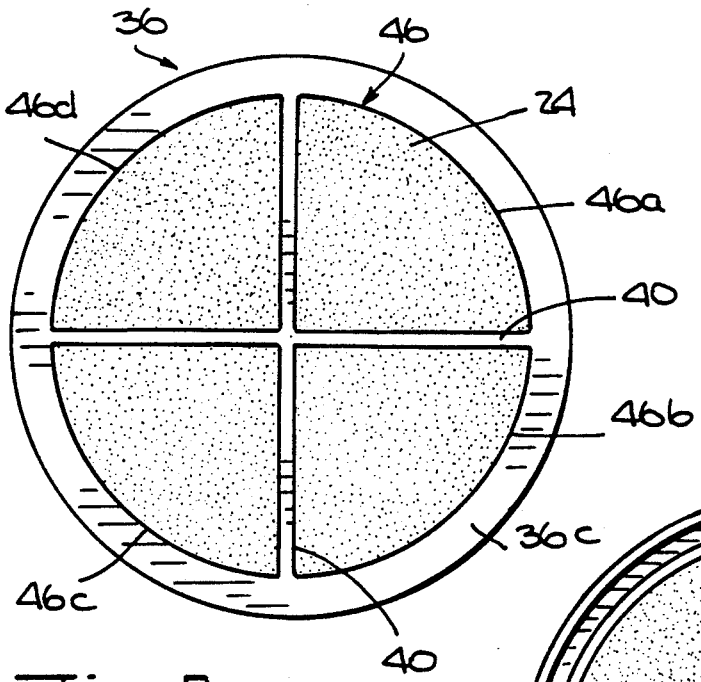
Fig. 2.
Fig. 3.
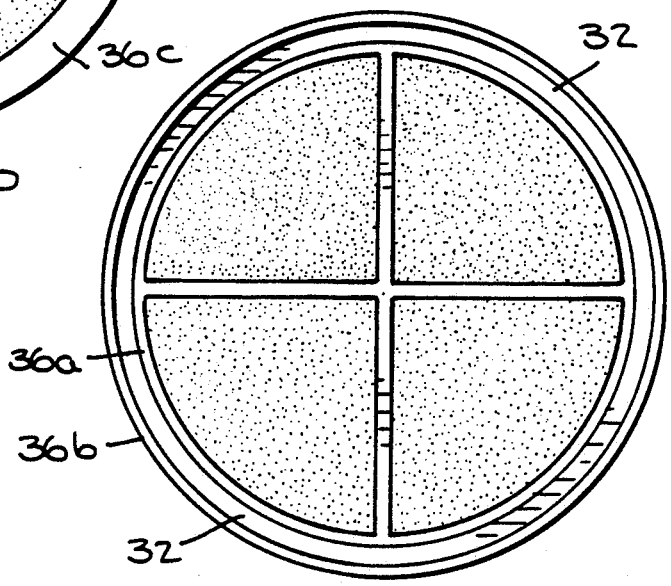

COFFEE CASSETTE

This application is a continuation of application Ser. No. 07/351,735, filed May 15, 1989, now abandoned.

BACKGROUND OF THE INVENTION

This invention generally relates to an apparatus for producing a highly desirable coffee product by the cup or pot; and additionally, to a prepackaged, single use cassette holding a quantity of coffee particles wherein hot water is passed through the cassette.

Prepackaged, single use cassettes of the above-described general type are known in the art, and for example, such a cassette is disclosed in U.S. Pat. No. 4,446,158. This reference discloses a coffee brewing receptacle having an opening in the bottom thereof, and a disposable, single use coffee container and filter unit that is designed to be held in the bottom opening of that coffee brewing receptacle. This coffee unit, in turn, comprises a frame, top and bottom filters secured to and covering the top and the bottom, respectively, of the frame, and individual quantities of coffee held in compartments formed inside the frame.

In use, the coffee container and filter unit is tightly secured against a lower flange of the coffee brewing receptacle, with the coffee unit extending across the bottom opening of that receptacle. This receptacle is then placed on top of a cup, and hot water is poured through the coffee brewing receptacle and the coffee unit secured across its bottom opening. The hot water is flavored as it flows through the coffee unit, producing coffee, which passes into the cup below the coffee unit. With the above described apparatus, it is sometimes difficult to secure the coffee container and filter unit in, and subsequently to remove that unit from, the brewing receptacle.

U.S. Pat. No. 3,937,134 discloses an apparatus for making coffee by percolation of preheated water. This apparatus comprises a reservoir adapted to receive water, and an extraction chamber adapted to receive a ground coffee tablet, which will expand or swell when percolated. A perforated wall separates the reservoir from the extraction chamber; and, in use, water flows or trickles from the reservoirs, through the perforated wall and into the extraction chamber through gravity.

U.S. Pat. No. 3,823,656 discloses a single-use, throw-away coffee brewing apparatus, including a filtering body adapted to receive a liquid and a coffee containing cartridge or capsule secured to the bottom of that body, A special locking design is used to hold the coffee cartridge to the filtering body to prevent relative movement therebetween and to form a seal between the coffee cartridge and the filtering body.

A number of difficulties have arisen in using prior art devices employing single-use, prepackaged coffee cassettes or cartridges to brew small quantities of coffee. For instance, often these devices do not consistently produce coffee with the same strength, the devices may take an undesirable length of time to make coffee, or the devices may be costly to make or use.

SUMMARY OF THE INVENTION

This invention provides an improved pre-packaged single use cassettes for producing a coffee product by the cup or pot.

Another aspect of the present invention is to mount a cassette, which contains roast and ground coffee particles, on an internal flange on the bottom of a liquid receptacle to hold the cassette in place therein while hot water is passed through the cassette.

A further aspect of this invention is to place the roast and ground coffee particles in individual compartments of a cassette, to place the cassette inside a packet, and then to withdraw air from the packet to form a vacuum therein in a manner that forms the coffee products in each compartment into a firm conglomerate to facilitate subsequently passing a liquid through the cassette.

By this invention, there is described an improved coffee cassette and its use with a liquid receptacle. This is an improvement over the apparatus described in U.S. Pat. No. 4,446,158 issued May 1, 1984 to English, et. al. The cassette of this invention comprises a container and filter unit. This comprises a uniform height impervious frame having an apertured center section and top and bottom filter layers covering the top and bottom of the frame. The filter layers are secured to the frame. The apertured center section includes a plurality of portions extending the height of the frame and a plurality of at least 3 separate compartments are formed. Within these compartments roast and ground coffee particles having a particle size predominantly in the range of about 100 microns to about 700 microns (preferably about 300 microns to about 500 microns) fills the space. The coffee particles are not tightly packed between the filter layers, i.e., the particles are movable especially when a vacuum is applied to the cassette.

A more specific type of coffee cassette is described in this invention which includes its use with a liquid receptacle having an internal locking flange. The cassette comprises a ring forming a bottom annular groove to receive the locking flange of the liquid receptacle and thereby to hold the cassette in place therein. The cassette further includes a plurality of ribs connected to and extending across the ring and separating the interior thereof into a multitude of sections, and coffee particles are disposed in these sections. A bottom filter and a top filter are secured to the ring and extend across the bottom and the top, respectively, of the ring to hold the flavoring particles in the sections thereof.

Preferably, the ring of the cassette includes an inside annular leg, an outside annular leg radially spaced from and concentric with the inside annular leg, and a shoulder portion connected to and extending between the annular legs, and the inside and outside annular legs and the shoulder portion form the above-mentioned annular groove of the ring. In addition, preferably the cassette is packaged in a vacuum sealed packet; and as it is so packaged, the mass of particles in each section of the ring is reshaped slightly and formed into a firm conglomerate to facilitate subsequently passing a liquid through the cassette.

Further benefits and advantages of the invention will become apparent from a consideration of the following detailed description given with reference to the accompanying drawings, which specify and show preferred embodiments of the invention.

BRIEF DESCRIPTION OF THE DRAWINGS

FIG. 1 is a vertical cross-sectional view through a liquid receptacle, a cassette held in the receptacle for 34 flavoring a liquid, and a cup beneath that receptacle.

FIG. 2 is a top view of the cassette of FIG. 1, with portions removed.

FIG. 3 is a bottom view of the cassette, also with portions removed.

DETAILED DESCRIPTION OF THE PREFERRED EMBODIMENTS

Figure 4:
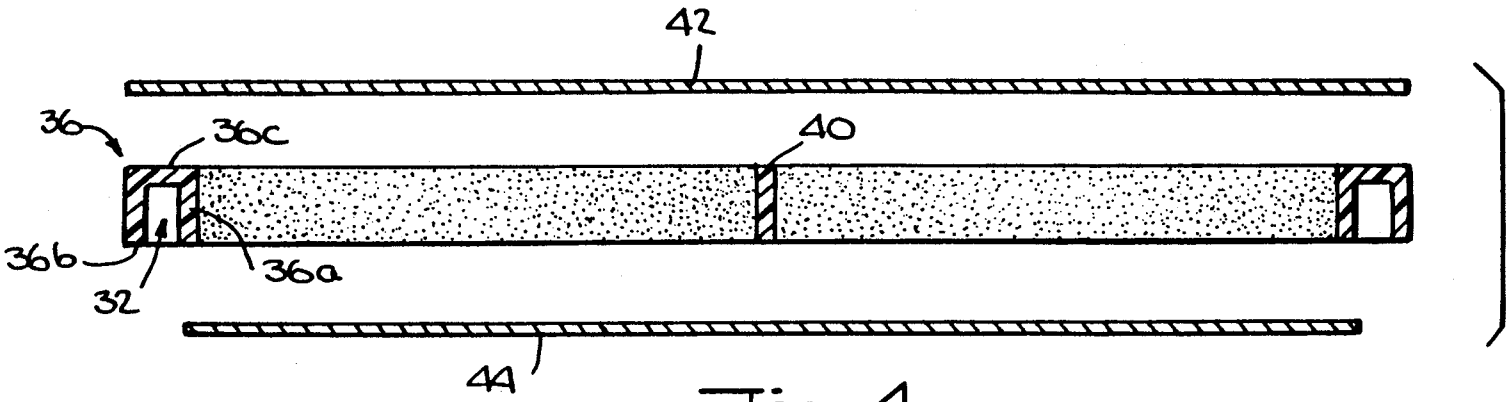
FIG. 4 is an enlarged, exploded side view of the cassette.

FIG. 1 illustrates liquid receptacle 12, flavoring cassette 14, and cup 16. Generally, receptacle 12 defines an interior 20 to receive a liquid and a bottom opening 22 to allow the liquid to pass through the receptacle; and, in use, cassette 14 is held in receptacle 12, extending over and across bottom opening 22. Cassette 14, in turn, holds a supply of coffee particles 24 (shown in FIGS. 2 and 3), and the receptacle and cassette are mounted on cup 16 so that liquid passes through the receptacle and the flavoring cassette and collects in the cup To hold cassette 14 in place inside receptacle 12, the receptacle includes a bottom flange 26 extending upward from bottom portion 30 thereof and around opening 22, the cassette forms an annular channel 32 having a shape complementing the shape of flange 26, and the cassette is placed in the receptacle with flange 26 in groove 32. This arrangement holds the cassette securely in place while hot water flows through it, and also forms an effective liquid seal between the cassette and the bottom of the receptacle, extending around opening 22, to prevent hot water from leaking out from the receptacle through the interface between the cassette and the liquid receptacle.

Any suitable liquid receptacle 12 may be used to hold cassette 14, As shown in FIG. 1, the receptacle has a generally flat bottom portion 30 and a generally cylindrically shaped side wall portion. Bottom portion 30 forms through opening 22, which preferably has a circular shape and is centered in the bottom portion. In addition, preferably flange 26 extends upward from bottom portion 30, immediately outside of and continuously completely around opening 22. A plurality of tabs, lugs or brackets (not shown) may be connected to bottom portion 30, for instance as disclosed in U.S. Pat. No. 4,446,158, so that receptacle 12 can be adapted to seat on any of a variety of sizes or diameters of cups or other containers and to facilitate positioning and holding the receptacle on the cup. Liquid receptacle 12 may be made in any suitable manner and from any suitable material, and preferably the bottom portion 30, side portion 34 and locking flange 26 are integrally formed together from a plastic material.

FIGS. 2–4 illustrate cassette 14 in greater detail; and generally, the cassette includes ring member 36, ribs 40, top filter 42 and bottom filter 44 and coffee particles 24; and the ring member 36, in turn, includes inside leg **36*a*, outside leg 36*b* and shoulder 36*c*. Both inside and outside legs 36*a* and b have annular or circular shapes, and the outside leg is radially spaced from and is concentric with the inside leg. Annular shoulder 36*c* is connected to and radially extends between top portions of legs 36*a* and b; and, in this way, shoulder 36*c* and legs 36*a* and b form the annular channel 32. Preferably, the height of legs 36*a* and b is substantially equal to the height of locking flange 26 of receptacle 12, and these legs are spaced apart a distance substantially equal to the width of that flange. As a result, cassette 14 can be mounted on flange 36** in a secure pressure fit thereagainst.

Ring member 36 defines an interior space 46, and ribs 40 are connected to the ring member and extend across that interior space to separate that space into a multitude of sections or compartments **46*a–d*. The embodiment of cassette 14 shown in the drawings includes two ribs 40, each of which extends diametrically across ring member 36, so that his interior space 46 is separated into four equal quadrants. Other arrangements are possible, however. For instance, cassette 14 may be provided with three radial ribs that are connected together to form a Y extending across space 46 and separating that space into three compartments. It has been found that a cassette with only two compartments is not considered satisfactory. As still another example, cassette 14 may be provided with three diametrical ribs, each of which extends across a respective one diameter of ring 36, and that, taken together, separate the interior of the ring into six equal compartments. Regardless of the specific number of ribs that cassette 14 is provided with, preferably each of these ribs has the same height as ring member 36**.

Filters 42 and 44 are suitably secured to top and bottom surfaces of ring member 36 and extend across space 46 to hold flavoring particles 24 therein while allowing liquids to pass through cassette 14 and through those particles. These filters may comprise any suitable filter paper, and they may be heat sealed, for example, to ring 36 or be otherwise secured thereto. Preferably, bottom filter 44 is secured to bottom surfaces of inner leg **36*a*, and this filter terminates radially inwardly of channel 32 to avoid interfering with placing or mounting cassette 14 on flange 26**.

Roast and ground coffee particles 24 are held in the compartments **46*a–d* of cassette 14; and preferably an equal amount of particles is held in each of the compartments, and each compartment is substantially filled with coffee particles. As will be understood by those of ordinary skill in the art, in order to make cassette 14, a first of the filters 42, 44 is secured to ring 36; the compartments 46*a–d* are filled with the desired amounts of particles 24; and after this, the other filter 42, 44 is secured to the remaining open end of ring 36**.

As also will be appreciated, any suitable cup 16 may be used with receptacle 12 and cassette 14. Many such cups are very well known, and it is unnecessary to describe cup 16 further herein.

Figure 7:
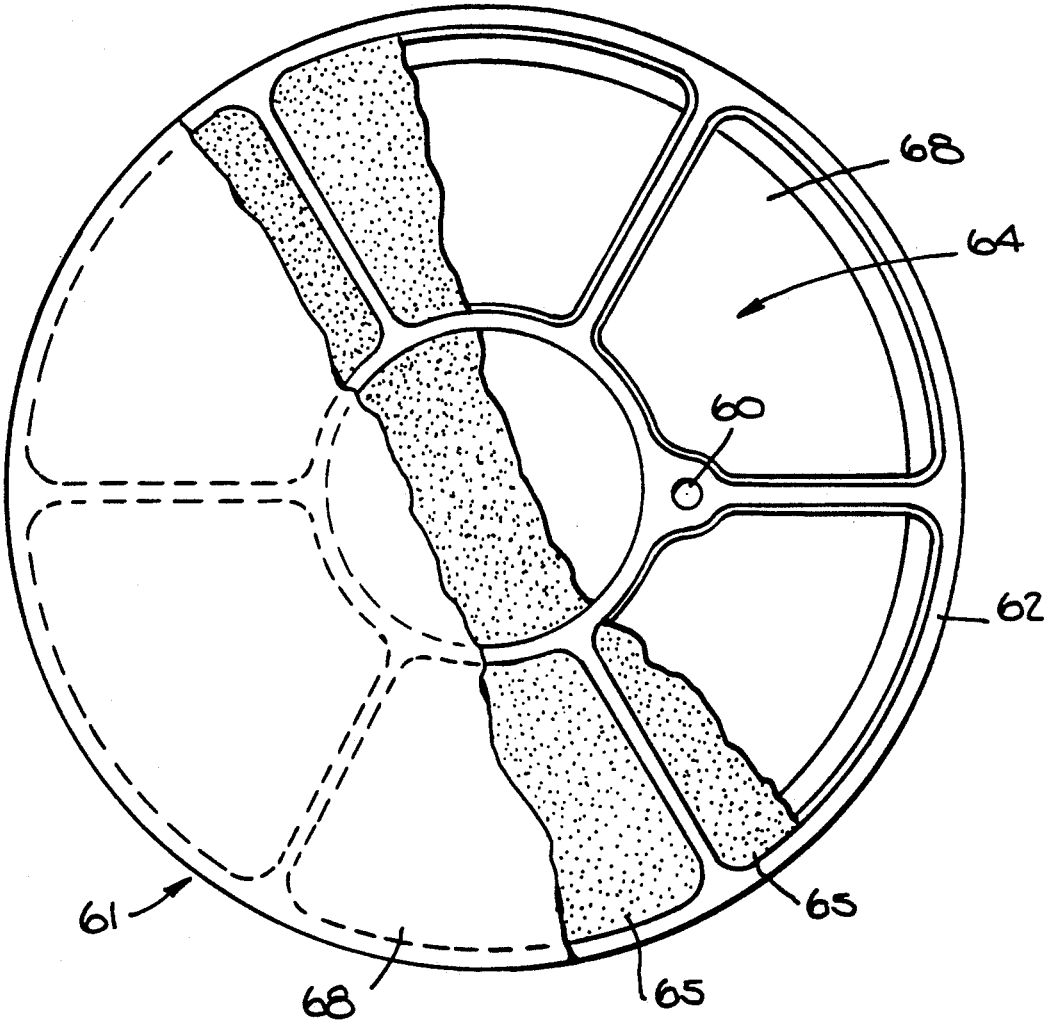
FIG. 7 is a plan view of a coffee cassette described in U.S. Pat. No. 4,446,158 which can be used in this invention to provide an improved coffee cassette.

FIG. 7 shows details of a modified disposable coffee container and filter unit 61. This unit 61 has a frame 62 with an apertured open center section 64. The unit 61 has a by-pass hole 60 formed in it and extending from top to bottom of the unit. The top filter sheet 63 is attached to the frame 62 and the bottom filter sheet 63 is also attached to the bottom of frame 62. The individual compartments 65 holds standard roast and ground coffee particles, coffee particles having a size of predominantly between about 100 to about 700 microns, more preferably between about 300 to about 500 microns.

The present invention is particularly well suited for making coffee; and in such a case, particles 24 are roast and ground coffee beans wherein the coffee is extracted with hot water. For example, when used to make coffee, it is believed that excellent results can be achieved if all of the particles 24 are sized predominantly between about 100 and about 700 microns preferably between about 200 to about 500 microns. This means that at least 75% and preferably at least 95% of the particle sizes fall between 100 and 700 microns preferably within the 300 to 500 micron size. The particle sizes of the coffee (which are roast and ground type) can include particles above or below the ranges of 300 to 500 microns and still provide outstanding results. The average median particle size preferred is between 350 to 450 microns. It is believed that such particles will not swell significantly as the coffee is made but will leave interspaces, and that hot water will pass through the particles relatively rapidly. Further, it is believed that by using ultrafine ground coffee particles, a beverage of a given strength can be made using less total coffee that if the ground coffee particles are larger.

Of course, the present invention can be used with widely varying particle sizes, and with many other types of particles such as tea components.

In use, with reference again to FIG. 1, cassette 14 is mounted on locking flange 26 of receptacle 12, and this receptacle is placed on cup 16, with the flavoring cassette generally centered over the top of the cup; and then, a liquid such as hot water, is poured into receptacle 12. The liquid passes through receptacle 12 and cassette 14 and is flavored by the particles 24 in the cassette, and the beverage produced thereby is collected in cup 16. After the liquid has flowed through cassette 14, the liquid receptacle and the cassette are removed from the cup. The cassette may then be removed from the liquid receptacle and disposed of, and the liquid receptacle can be washed and stored for another use. The cassette 14 is very easy to place in and remove from liquid receptacle 12; and, for example, the cassette can be removed by just inverting the liquid receptacle.

Liquid receptacle 12 and flavoring cassette 14 may be made in various sizes. For instance, as illustrated in FIG. 1, the receptacle and cassette are of a size specifically designed to make one cup of coffee. The receptacle and cassette may be made larger or smaller. Larger cassettes, for instance, may be ideally suited to restaurant use or to use on airplanes, where each cassette may be used to make 10–12 cups of coffee. Although atmospheric brewing of the coffee is satisfactory for making multiple cups of coffee, it is desirable to place these larger quantities of coffee under pressure to decrease brewing time.

Figure 5:
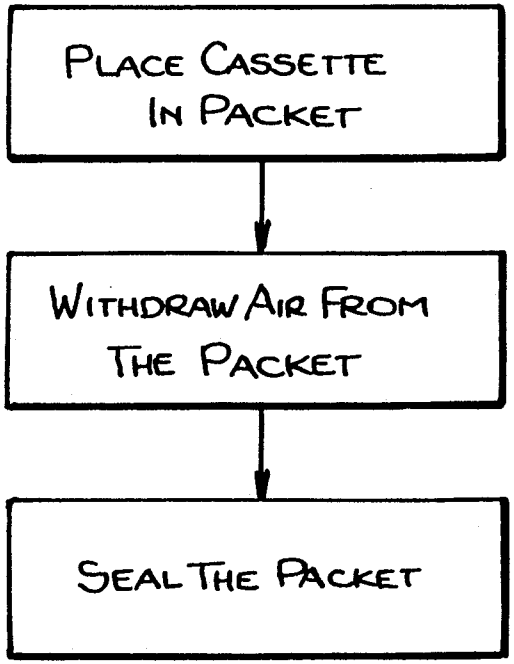
FIG. 5 generally indicates a procedure for packaging the cassette.

It has been found that the rate at which liquid flows through cassette 14 may be dramatically improved as a result of the preferred method used to package the cassette. To elaborate, with reference to FIG. 5, after cassette 14 is made, as described above, preferably the cassette is placed in a small envelope or packet, most or all of the air is withdraw-n by vacuum from the packet, and the packet is sealed, producing a package referred to as a sealed vacuum pack. This means that the amount of oxygen removed during the vacuum operation is significantly reduced and desirably to as low as 1% of the total oxygen originally present. The principle reason for packaging the cassette in this way is to maintain the freshness of the flavoring particles 24. It has been found, though, that as air is withdrawn from the packet, the mass of particles in each compartment 46*a–d* of the cassette is re-shaped and formed into a firm conglomerate; and that when the cassette is later removed from the packet and used in the manner outlined above, the liquid that is poured into receptacle 12 flows through the cassette at a rate greater than the rate at which the liquid flows through an otherwise identical cassette that was not similarly vacuum packed.

It is important that the coffee particles in the individual sections of the cassette be distributed in a manner that these sections are not completely filled with articles so that there is room for distribution of the coffee particles to form a conglomerate of particles in each section of the cassette when placed in a small envelope or packet and vacuum is applied to remove the oxygen to form a sealed vacuum pack. If the coffee particles are not distributed when vacuum is applied, the advantages of the vacuum process are not achieved.

The following examples will help to further illustrate the invention.

EXAMPLES 1 Through 10

Cassettes, identical to the English et. al., U.S. Pat. No. 4,446,158 (Drawing FIG. 7) having a diameter of 63 to 65 mm placed in a water receptacle were provided with designated amounts of different sized roast and ground coffee particles as set forth in Table I. The cassettes were sealed and the designated amounts of hot water were poured over the cassettes to produce the cup of coffee. None of these tests permitted any water to by-pass the cassette. Some of the cassettes were vacuum packed and then used. The brew time, i.e. water passing through the cassette, was measured and % soluble solids determined. The following results were determined.

TABLE I

| Example | Roast & Ground Coffee particle Size | Weight of Coffee In Cassette Grams | Amount of Hot Water Poured through Casette ml. | Brewing Time | Soluble Solids % |
|---|---|---|---|---|---|
| 1 | Unscreened - Not predominantly between 300–500 microns | 6.0 | 140 | 2 min. 40 sec. | 1.18 |
| 2 | 300–500 microns 30% > 500 microns 20% < 200 microns | 6.0 | 140 | 1 min. 35 sec. | 0.93 |
| 3 | Example 2 Vacuum packed | 6.0 | 140 | 1 min. 12 sec. | 1.06 |
| 4 | 300–500 microns All particles in range | 6.0 | 140 | 1 min. 57 sec. | 1.01 |
| 5 | Example 4 Vacuum packed | 6.0 | 140 | 1 min. 12 sec. | 0.96 |
| 6 | Unscreened - Not predominantly between 300–500 microns | 5.5 | 140 | 2 min. 6 sec. | 1.08 |

TABLE I-continued

| Example | Roast & Ground Coffee particle Size | Weight of Coffee In Cassette Grams | Amount of Hot Water Poured through Casette ml. | Brewing Time | Soluble Solids % |
|---|---|---|---|---|---|
| 7 | 300-500 microns 30% > 500 microns 20% < 200 microns | 5.5 | 140 | 1 min. 45 sec. | 0.88 |
| 8 | Example 7 Vacuum packed | 5.5 | 140 | 43 sec. | 0.90 |
| 9 | 300-500 microns All particles in range | 5.5 | 140 | 1 min. 6 sec. | 0.85 |
| 10 | Example 9 Vacuum packed | 5.5 | 140 | 37 sec. | 0.80 |

It should be noted the unscreened samples which did not contain a predominantly specific range coffee particle size, required longer brewing time compared to the 300-500 micron samples and vacuum packed samples. Specific particle sizes and vacuum packing of the cassette decreased brewing times.

EXAMPLES 11 THROUGH 18

Cassettes identical to those of FIGS. 2 and 3 of the drawings in this application, having a diameter of 68/70 mm. and placed in a water receptacle, were provided with 7 grams of different sized roast and ground coffee particles as set forth in Table II. The cassettes were sealed and the designated amounts of hot water were poured over the cassettes to produce the cups of coffee. Some of the cassettes were vacuum packed and then used. The brew time, i.e., time of water passing through the cassette, was measured and % soluble solids determined. The following results were obtained.

TABLE II

| Example | Roast & Ground Coffee particle Size | Weight of Coffee In Cassette Grams | Amount of Hot Water Poured through Casette ml. | Brewing Time | Soluble Solids % |
|---|---|---|---|---|---|
| 11 | Unscreened - Not predominantly between 300-500 microns | 7.0 | 165 | 2 min. 22 sec. | 1.15 |
| 12 | Example 11 Vacuum packed | 7.0 | 165 | 1 min. 15 sec. | 1.15 |
| 13 | 300-500 microns 30% > 500 microns 20% < 200 microns | 7.0 | 165 | 1 min. 17 sec. | 0.94 |
| 14 | Example 13 Vacuum packed | 7.0 | 165 | 46 sec. | 0.93 |
| 15 | 300-500 microns All particles in range 410 micron average mean particle size | 7.0 | 165 | 1 min. 8 sec. | 0.91 |
| 16 | Example 15 Vacuum packed | 7.0 | 165 | 39 sec. | 0.84 |
| 17 | 300-500 microns All particles within range | 7.0 | 165 | 1 min. 7 sec. | 0.92 |
| 18 | Example 17 Vacuum packed | 7.0 | 165 | 26 sec. | 0.80 |

It should be noted the unscreened samples which did not contain a predominantly specific range coffee particle size required longer brewing times compared to the 300-500 micron samples and the vacuum packed examples Specific-particle size and vacuum packaging of the cassette decreased brewing times.

EXAMPLES 19 THROUGH 26

Cassettes, identical to those of FIGS. 2 and 3 of the drawings in this application, having a diameter of 68/70 mm. and placed in a water receptacle, were provided with 7 grams of different size roast and ground coffee particles to demonstrate the influence of grind distribution. Table III set forth these results. The cassettes were sealed and the designated amounts of hot water were poured over the cassettes to produce the cups of coffee. The brew time, i.e., time of water passing through the cassette, was measured and % soluble solids determined. The following results were obtained:

TABLE III

| Example | Roast & Ground Coffee particle Size | Weight of Coffee In Cassette Grams | Amount of Hot Water Poured through Casette ml. | Brewing Time | Soluble Solids % |
|---|---|---|---|---|---|
| 19 | Unscreened - Average mean particle size 340 microns | 7.0 | 170 | 1 min. 48 sec. | 1.27 |
| 20 | All above | 7.0 | 170 | 1 min. | 1.16 |

TABLE III-continued

| Example | Roast & Ground Coffee particle Size | Weight of Coffee In Cassette Grams | Amount of Hot Water Poured through Casette ml. | Brewing Time | Soluble Solids % |
|---|---|---|---|---|---|
| | 100 microns | | | 20 sec. | |
| 21 | All above 200 microns | 7.0 | 170 | 1 min. 9 sec. | 1.08 |
| 22 | 200–400 microns | 7.0 | 170 | 1 min. 33 sec. | 1.25 |
| 23 | 300–500 microns | 7.0 | 170 | 1 min. 12 sec. | 1.08 |
| 24 | 300–600 microns | 7.0 | 170 | 1 min. 14 sec. | 1.06 |
| 25 | 400–600 microns | 7.0 | 170 | 56 sec. | 0.93 |
| 26 | 500–700 microns | 7.0 | 170 | 58 sec. | 0.81 |

The data of Table III illustrate the improvements in brewing time of the cassettes containing the 100 to 700 micron ranges compared to the unscreened example 19.

Figure 6:
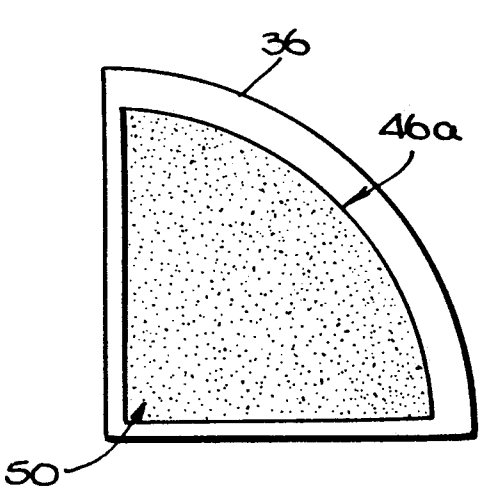
FIG. 6 shows a section of the cassette after it has been removed from a packet in which it was packaged.

FIG. 6 generally illustrates the shape into which the mass of particles in a compartment 46*a* appears to be formed during the above-described procedure for packaging cassette 14. This mass of particles maintains a generally triangular shape, but with the corners of the triangle slightly curved as shown at 50. Further, it appears that the particles are no longer uniformly distributed over the area of compartment 46*a*, but instead there appears to be a slightly higher concentration of the particles toward the center of the compartment and a slightly lower concentration of the particles toward the periphery of the compartment.

While it is apparent that the invention herein disclosed is well calculated to describe the aspects of this invention previously stated, it will be appreciated that numerous modifications and embodiments may be devised by those skilled in the art, and it is intended that the appended claims cover all such modification and embodiments as fall within the true spirit and scope of the present invention.

What is claimed is:

1. A cassette for flavoring a liquid and for use with a liquid receptacle, said cassette comprising:

(a) a uniform height, impervious frame having an apertured center section;

(b) said center section including a plurality of ribs extending the height of said frame and connected to and extending across said frame and separating said center section into a plurality of at least three separate sections;

(c) said separate sections containing individual quantities of roast and ground coffee particles with the particles distributed in a manner such that each of the sections are not completely filled with said particles;

(d) a bottom filter and a top filter secured to the frame and extending across the bottom and the top of the frame to hold said roast and ground coffee particles therein;

said cassette having been treated by placing said roast and ground coffee containing cassette, with each section not completely filled with said particles, in a small envelope or packet and having most or all of the air withdrawn by vacuum from the cassette containing envelope or packet during a vacuum sealing of the envelope or packet such that the roast and ground coffee particles in each of said sections are no longer uniformly distributed over the area of each section but are reshaped and formed into a generally triangular, firm conglomerate in each of said sections and exhibit slightly higher concentrations of said particles toward the center of each of said sections and slightly lower concentration of said particles toward the periphery of each of said sections, such that when the cassette is removed from the envelope or packet and used to make a beverage, the flow rate of liquid through the cassette is increased relative to a cassette not previously vacuum packed.

2. The cassette of claim 1 wherein said cassette is sealed under vacuum in a packet.

3. The cassette of claim 2 wherein said beverage particles are roast and ground coffee particles having a predominant particle size in the range from about 100 microns to about 700 microns.

4. The cassette of claim 2 wherein said beverage particles are roast and ground coffee particles having a predominant particle size in the range from about 300 microns to about 500 microns.

5. The cassette of claim 1 wherein said beverage particles are roast and ground coffee particles having a predominant particle size range from about 100 microns to about 700 microns.

6. The cassette of claim 1 wherein said beverage particles are roast and ground coffee particles having a predominant particle size in the range from about 300 microns to about 500 microns.

7. The combination of claim 1 and a liquid receptacle forming an interior for receiving liquid and forming a bottom opening for passing a liquid beverage outward from said interior; said cassette being dimensioned to be positioned in the bottom of the receptacle over said bottom opening.

8. The combination of claim 7 wherein said liquid receptacle includes an internal locking flange adjacent to said bottom opening and wherein said cassette includes a groove in said frame, with said flange extending upward from said bottom opening to engage with said groove in said cassette frame.

9. A cassette for flavoring a liquid and for use with a liquid receptacle, said liquid receptacle having an interior for receiving liquid and having a bottom portion defining a bottom opening for passing the liquid outward from said interior, said liquid receptacle further including an internal locking flange adjacent to and around said bottom opening and said flange extending upward from said bottom portion, said cassette comprising:

(a) a ring defining an interior and having a bottom surface and a top surface, the ring including (i) an inside annular leg, (ii) an outside annular leg radially spaced from and concentric with the inside annular leg, and (iii) a shoulder portion connected to and extending between the inside and outside annular legs; the inside and outside annular legs and the shoulder portion define a bottom annular groove to receive said locking flange on said liquid receptacle, said cassette including said annular groove being dimensioned and shaped such that when said cassette is placed in said liquid receptacle with said annular groove positioned down onto said locking flange, the cassette is held securely in place while a liquid flows through it and a liquid seal is formed between said cassette and the bottom of the receptacle extending around said opening to prevent liquids from leaking out from the interface between said cassette and said liquid receptacle;

(b) a plurality of ribs connected to and extending across said ring and separating the interior thereof into a multitude of at least 3 separate sections;

(c) said separate sections containing individual quantities of roast and ground coffee particles with the particles distributed in a manner such that each of the sections are not completely filled with said particles;

(d) a bottom filter and a top filter secured to the ring and extending across the bottom and the top, respectively, of the interior of said ring to hold the roast and ground coffee particles therein;

(e) said cassette having been treated by placing said roast and ground coffee containing cassette, with each section not completely filled with said particles, in a small envelope or packet and having most or all of the air withdrawn by vacuum from the cassette containing envelope or packet during a vacuum sealing of the envelope or packet such that the roast and ground coffee particles in each of said sections are no longer uniformly distributed over the area of each section but are reshaped and formed into a generally triangular, firm conglomerate in each of said sections, and exhibit slightly higher concentrations of said particles toward the center of each of said sections and slightly lower concentration of said particles toward the periphery of each of said sections, such that when the cassette is removed from the envelope or packet and used to make a beverage, the flow rate of liquid through the cassette is increased relative to a cassette not previously vacuum packed.

10. A cassette according to claim 9 wherein said internal locking flange has a given width and the inside and outside annular legs of said cassette are radially spaced apart the given width.

11. A cassette according to claim 10 wherein said internal locking flange has a given height and the height of each of said inside and outside legs is said given height.

12. A cassette according to claim 9 wherein:

the bottom filter is secured to the inside leg of said ring; and the bottom filter terminates radially inwardly of said annular groove to avoid interfering with placing the cassette on said locking flange.

13. A cassette according to claim 9 wherein said liquid flavoring particles are roast and ground coffee particles having the predominant sizes between about 200 and about 500 microns.

14. The combination of the cassette of claim 9 and a liquid receptacle forming an interior for receiving liquid and forming a bottom opening for passing a liquid beverage outward from said interior, said cassette being dimensioned to be positioned in the bottom of the receptacle over said bottom opening.

15. The cassette of claim 9 wherein said cassette is sealed under vacuum in a packet.

* * * * *